United States Patent [19]

Thirion et al.

[11] 4,449,385

[45] May 22, 1984

[54] ELECTRO-MECHANICAL ANTI-THEFT DEVICE FOR AUTOMOBILE VEHICLES

[75] Inventors: Andre Thirion, Chevigny-Saint-Sauveur; Antoine Sorba, Le Mesnil Saint Denis; Jean-Claude Dany, Saint Cyr l'Ecole; Andre Pacaud, Saclay, Orsay; Gerard Attal, Fresnes, all of France

[73] Assignee: Antivols Simplex, Dijon-Saint-Apollinaire, France

[21] Appl. No.: 313,151

[22] Filed: Oct. 20, 1981

[51] Int. Cl.[3] ..... E05B 47/00

[52] U.S. Cl. ..... 70/277; 70/DIG. 51

[58] Field of Search ..... 70/277, 278, DIG. 51, 70/282, 281, 280; 250/569; 340/149 R; 361/171, 172

[56] References Cited

U.S. PATENT DOCUMENTS

| | | | |
|---|---|---|---|
| 3,769,514 | 10/1973 | Clark | 250/341 |
| 4,250,533 | 2/1981 | Nelson | 361/172 |
| 4,286,305 | 8/1981 | Pilat | 361/172 |
| 4,347,545 | 8/1982 | Weishaupt | 361/172 |

*Primary Examiner*—Robert L. Wolfe

*Attorney, Agent, or Firm*—Holman & Stern

[57] ABSTRACT

An anti-theft device for an automotive vehicle includes a lock and key housed separately and remote from a bolt and its actuating mechanism. The bolt portion is located in an inaccessible housing and connected to the lock by means of a burglar-proof connection. The electronic lock arrangement employed permits of a large number of combinations and thereby increases the security of the anti-theft device. By placing the bolt in an inaccessible housing, direct tampering with the locking bolt is precluded.

11 Claims, 4 Drawing Figures

ELECTRO-MECHANICAL ANTI-THEFT DEVICE FOR AUTOMOBILE VEHICLES

The invention relates to anti-theft devices designed to lock an element which is essential to the operation of the vehicle, such as the steering column, and simultaneously to ensure the switching of the electrical circuits of the vehicle. These anti-theft devices therefore provide a double safety against theft since, in the locked position the vehicle is immobilised mechanically and its electrical circuits are open which prevents in particular starting and the supply to the motor.

Anti-theft devices of this type used up to now comprise, in the same housing, a safety lock controlled by a key, the rotation of the lock cylinder controlling the movements of a locking bolt and simultaneously the actuation of an electrical switch.

Although these known anti-theft devices are in general satisfactory, they have various drawbacks. The first drawback is that they are very vulnerable, the technical means available to thieves enabling them to unlock the lock relatively easily using fairly simple and readily available instruments. Moreover, the construction of the anti-theft device in a single block containing both the lock, the locking bolt and its control means, as well as the electrical switch makes them particularly sensitive to burglary attempts. The lock must necessarily be accessible and may therefore be subject to burglary attempts using various methods such as forced rotation of the cylinder, forced depression of the cylinder, removal of the cylinder etc.

The present invention aims to provide a new anti-theft device for an automobile vehicle which does not have the drawbacks of known anti-theft devices by means of the use of an electronic lock controlling a lock unit which is distanced and inaccessible, these two elements being connected by a burglar-proof connection.

For this purpose, the invention relates to an anti-theft device for an automobile vehicle comprising a locking bolt arranged to engage with an element locking the vehicle, such as the steering column, characterised in that it comprises:

(a) an electronic lock comprising a coded key, a device for controlling the operation of the anti-theft device during the introduction and removal of the key and a device for reading the key code and for generating a corresponding signal;

(b) a bolt housed in an inaccessible housing and comprising a locking bolt controlled by an actuator, a device for receiving signals transmitted by the lock and for comparison with coded signals contained in a memory, an electronic device for controlling the actuator and an electrical supply switch for the vehicle, the electronic control device receiving the signals transmitted by the receiver and comparison device and signals representing the position of the locking bolt and the rest or operational condition of the motor of the vehicle;

(c) connections between the lock and the bolt ensuring the electrical supply to the lock, the transmission of the coded signals between the lock and the bolt, and the transmission of the operating control of the anti-theft device from the lock to the bolt.

The use of an electronic lock enables a considerable increase of the number of combinations possible and thus considerably strengthens the security of the anti-theft device. The transmission of the bolt control in the form of coded signals prevents the unauthorised actuation of the bolt even by direct action on the bolt aperture. The arrangement of the bolt in an inaccessible housing prevents any direct action on the locking bolt control actuator.

The key preferably comprises coded perforations and the reading device comprises an electroluminescent diode matrix, a receiver diode matrix disposed opposite the electroluminescent diodes, and a circuit for forming the signal transmitted from the receiver diodes.

In a preferred embodiment the lock comprises an electronic device arranged to generate, from signals transmitted by the lock, the signals required for reading of a key, and a circuit designed to supply the currents required for the excitation of the electroluminescent diodes.

The key advantageously comprises a slot for positioning with respect to the diode matrices. The lock preferably comprises a device for generating a starter control signal constituted by a contactor disposed at the end of the lock so as to be actuated by the key when it is completely inserted into the lock, resilient means returning the key opposite the diode matrices as soon as it has been released.

The invention also relates to several preferred embodiments of the bolt. In accordance with one of these embodiments, the bolt comprises a pilot circuit supplied directly by the accumulator battery of the vehicle and arranged to circulate the electrical supply of the anti-theft device on reception of a control signal transmitted by the lock during a movement of the key. The electronic control device contained in the bolt advantageously controls the discontinuation of the electrical supply from the anti-theft device after the operations of the latter have been carried out.

In a particularly advantageous embodiment of the invention, the locking bolt is controlled by a d.c. electrical motor by means of an endless screw. The locking bolt may occupy a locked position and an unlocked position, and a garage position. The electrical switch is advantageously linear and the movable contacts are supported by the locking bolt which is slideable.

The invention is now described in further detail with reference to the accompanying drawings, in which.

Figure 1:
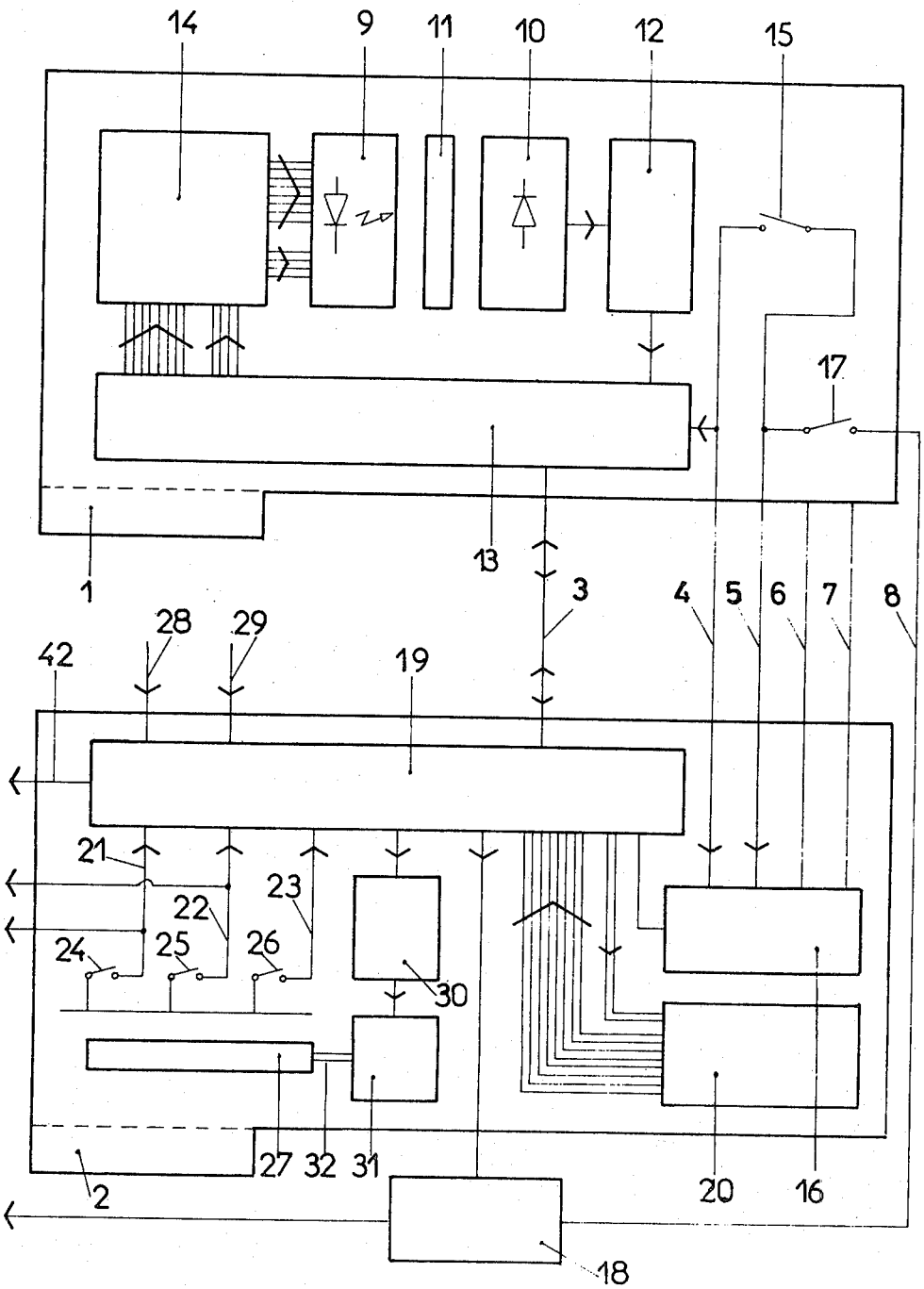
FIG. 1 is a circuit diagram of an anti-theft device in accordance with an embodiment of the invention.
Figure 2:
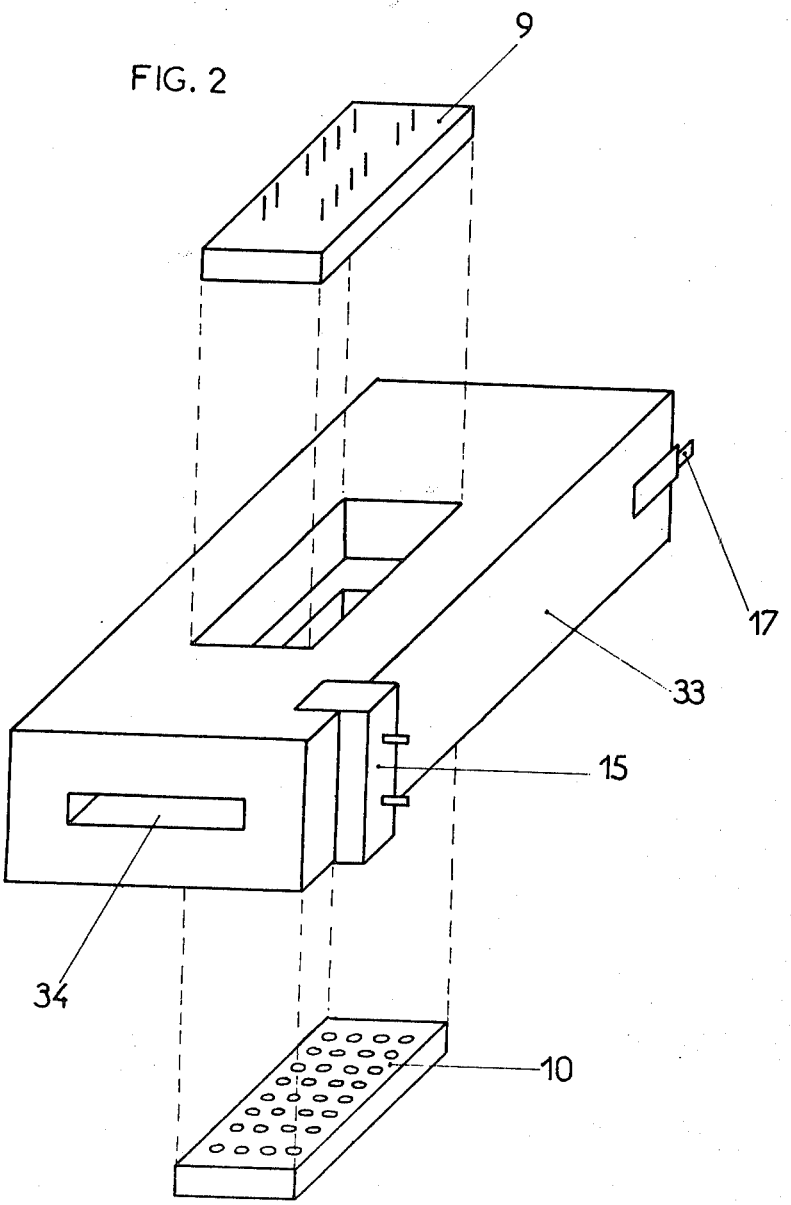
FIG. 2 is an exploded perspective diagram of the optical-electronic key reading device of the anti-theft device of FIG. 1.
Figure 3:
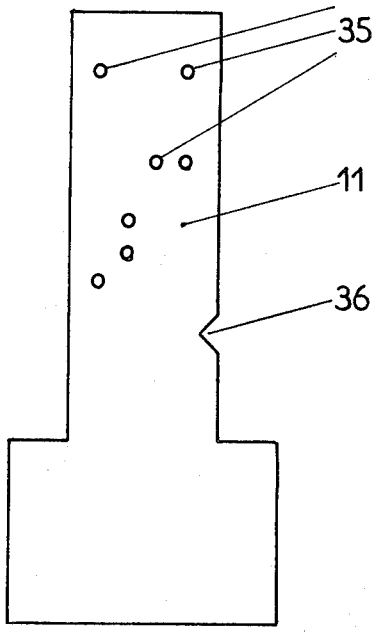
FIG. 3 is a plan diagram of a key used with the device of FIG. 2.
Figure 4:
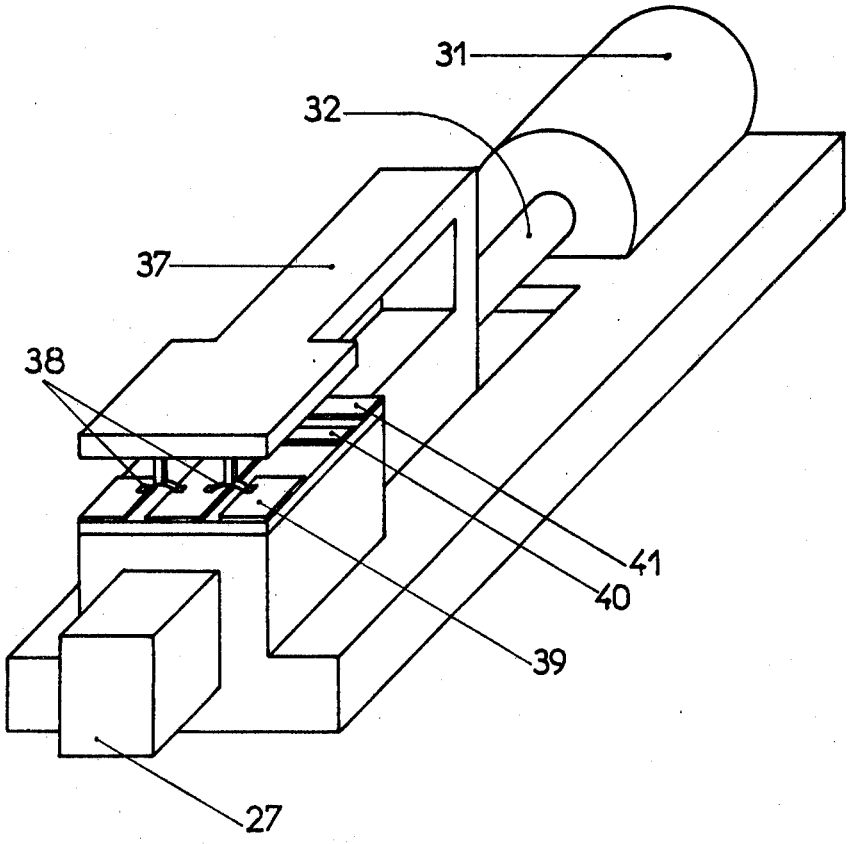
FIG. 4 is a perspective diagram of the electromechanical portion of the bolt of the anti-theft device of FIG. 1.

The anti-theft device comprises a lock 1 and a bolt 2 connected by connection wires 3, 4, 5, 6, 7 and 8.

The lock 1 comprises an electroluminescent diode matrix 9 and a receiver diode matrix 10, preferably operating in the infrared range and between which a key 11 may pass. The receiver diode matrix is connected to the input of an amplifier circuit 12 whose output is connected to the input of a micro-processor 13. The micro-processor 13 is connected to the input of an amplifier 14 of the supply of the diode matrix 9.

During its displacement, the key 11 actuates a supply contactor 15 connected to a d.c. supply 16, for example 5 V, by the connection wires 4 and 5. The key 11 also actuates, when completely inserted, a starter contactor 17 connected to the wire 5 and to a starter relay 18 by the wire 8.

The microprocessor 13 of the lock 1 is connected to a microprocessor 19 of the bolt 2 by a bidirectional connection wire 3 and an output of the microprocessor 19 controls the supply 16 which receives, in addition to the control wire 4 and the 12 V supply wire 5, the 5 V supply wire 6 and the earth wire 7.

The microprocessor 19 is supplied by a programmable code memory 20, via lines 21, 22, 23 from switches 24, 25, 26 respectively which are actuated by the locking bolt 27 during its translation. The microprocessor also has an input connected to a line 28 which is connected to an engine movement indicator and a further input connected to a line 29 connected to a vehicle displacement indicator.

An output of the microprocessor 19 is connected to the starter relay 18 and another output to an amplifier 30 controlling the electrical motor 31 for actuating the bolt 27 by an endless screw 32.

The key 11 slides in the key slot 34 of a housing 33 supporting the diode matrices 9 and 10 and the contactors 15 and 17. The key comprises coded perforations 35 which are read by the diode matrices, and a notch 36 for positioning the key with respect to the diode matrices. Resilient means (not shown) return the key 11 opposite the the diode matrices 9 and 10, after depression of the end contactor 17 and release of the key, by engagement of the notch 36 with a positioning member (not shown).

The locking bolt 27 supports a movable element 37 provided with two contacts 38, which are connected, in accordance with the position of the bolt 27, with locking position contacts 39, garage position and accessory supply contacts 40 and contacts for the operating position and for the general electrical supply of the vehicle 41, which constitute the switches 24, 25, 26 respectively.

The operation of the above-mentioned device is as follows:

The introduction of the key 11 into the key slot 34 actuates the switch 15, which, by means of the pilot circuit, switches on the supply 16 of the electronic assembly of the anti-theft device. The microprocessor 13, supplied in this way, supplies the amplifier 14 which supplies the diodes 9. The diode matrix 10 receives the radiation from the diodes of the matrix 9 which has passed through the perforations 35 of the key 11 and the signal generated in this way is supplied to the microprocessor 13 after amplification in the amplifier 12.

This signal is applied by the line 3 to the microprocessor 19 which also receives the content of the memory 20 and compares the two signals. If they are different, after several attempts it transmits an alarm signal via a line 42. If they are identical it supplies a command to the motor 31 by means of the amplifier 30 which causes displacement of the bolt 27 to the "contact" position.

At the end of insertion, the key 11 actuates the switch 17 which supplies a signal to the starter relay 18. The key 11 then returns automatically into the reading position opposite the diode matrices 9 and 10. The microprocessor 19, if the line 28 supplies it with a signal indicating that the engine of the vehicle has stopped, supplies a signal to the relay 18 which actuates the starter.

At the end of this process, the bolt 27 is in the operating position, as its contact 38 is contacted with the fixed contact 41 such that the electrical supply of the vehicle is ensured. The engine of the vehicle is started under the action of the starter and the vehicle is operative. The supply 16 is cut off by the microprocessor 19 such that the anti-theft device only has the pilot current passing through it.

If the operator withdraws the key 11, the switch 15 is again actuated and the supply 16 is re-actuated. The microprocessor 19 analyses the data transmitted to it by the line 29. If the vehicle has stopped, a command is supplied to the engine 31 which brings the bolt into the locking position. The supply 16 is then cut off. If the vehicle is not stationary, no command is supplied to the engine 31 and the supply 16 is cut off. In order to stop the key 11 should be re-inserted, which resets the supply 16 and brings the electronic system to the normal operating position. By repeated extraction, with the vehicle stopped, the bolt moves into the locking position. The displacement of the movable contact 38 cuts off the electrical supply of the vehicle, and its engine stops. The electronic system then returns to the pilot condition.

If the key 11 is not completely inserted during the first insertion, the switch 17 is not actuated, a time lapse occurs and the microprocessor 19 then supplies a message to the engine 31 which causes the passage of the bolt 27 to the "garage" position. Two actions on the contactor 17 are then required to bring the bolt 27 into the "operating" position and to produce starting of the engine of the vehicle. On the other hand, withdrawal of the key 11 automatically produces the passage of the bolt 27 into the locking position.

For a voluntary passage into the "garage" position the operator inserts the key without actuating the switch 17 and depresses, in a given time lapse, a button (not shown) which supplies a signal to the microprocessor 19 which supplies a command to move into the "garage" position to the engine 31. If the button is not actuated within the given time lapse, the microprocessor 19 supplies a command to pass into the locking position on withdrawal of the key.

Numerous options may be provided with the electronic anti-theft device of the invention. For example, a change of code may be provided by introducing a new code into the memory 20, wherein this new code may only be introduced in the presence of the key for the previous code.

The key 11 may be made of any suitable material and the perforations 35 may be drilled by any known method. They may be made invisible to the naked eye, for example by covering them with an opaque material which may be traversed by the radiation from the diodes 9. The reproduction of the keys is thus made difficult.

The microprocessor 19 has the role of "master" with respect to the microprocessor 13 which is the "slave". The microprocessor 13 is used essentially to read the key whilst all the commands are given by the microprocessor 19 which is inaccessible.

The use of a pilot current even while the vehicle is operating enables the current consumption of the anti-theft device to be negligible and provides a very good immunity to electronic noises as soon as the key is no longer being moved. In addition the re-supply of voltage to the microprocessors on each movement of the key zero-sets them, which prevents any starting in a random position.

Any defect or breakdown of any part of the anti-theft device may not have any serious consequences. In effect, the command to pass to the locking position may only be given if the assembly of the anti-theft device is functioning correctly and if the locking conditions are provided. These conditions, which include in the embodiment described, the stoppage of the vehicle and the switching off of its motor, may also include further conditions such as the switching off of the headlights. Moreover, starting may be subject to additional conditions, for example buckling of the safety belts, gear lever in the neutral position, etc.

We claim:

1. An anti-theft device for an automotive vehicle comprising:

electronic lock means comprising:

a coded key; control means for receiving said coded key and for activating said anti-theft device during introduction and extraction of said coded key; and reading means for reading the coded key in said control means and providing coded key signals corresponding to the code of the key; and bolt means located in an inaccessable housing remote from said lock means and comprising:

a movable locking bolt; bolt actuator means for controling movement of said locking bolt; memory means for storing coded signals; comparator means for comparing the coded key signals with the stored coded signals from said memory means and providing an enable signal when the coded key signals correspond to the stored coded signals; signal responsive switch means for alternatively supplying and interrupting electrical operating power to force said vehicle; contact means responsive to positions of said locking bolt for providing corresponding bolt position signals; and electrical control means responsive to said enable signal and said bolt position signals for actuating said bolt actuator means and for providing a signal to operate said switch means.

2. A device according to claim 1 wherein said key has coded perforations defined therein, and wherein said reading means comprises a matrix of electroluminescent diodes, a matrix of receiver diodes disposed opposite the electroluminescent diodes, and key receiving means for passing light energy from said electroluminescent diodes to said receiver diodes through said coded perforations.

3. A device according to claim 2 wherein said electroluminescent diodes transmit in the infrared spectrum.

4. A device according to claim 2 wherein said lock comprises means responsive to the position of said locking bolt for enabling said locking means and energizing said electroluminescent diodes.

5. A device according to claim 2 wherein said key includes a positioning notch for positioning the key in said key receiving means to align said coded perforations with respect to said diode matrices.

6. A device according to claim 5 wherein the lock means comprises means for generating a starter control signal which includes a contactor disposed at an end of said key receiving means in a position to be actuated by the coded key when the key is completely inserted in the key receiving means, and resilient means for urging the key into a position wherein the coded perforations are aligned with said diode matrices.

7. A device according to claim 1 wherein said bolt means comprises a pilot circuit supplied directly by a vehicle battery and including means for providing electrical power for the anti-theft device in response to a predetermined bolt position signal from said contact means.

8. A device according to claim 4 wherein said electronic control means automatically cuts off electrical power for the anti-theft device after predetermined operational sequences have been carried out.

9. A device according to claim 1 wherein said bolt actuator means comprises a d.c. motor driving an endless screw.

10. A device according to claim 1 wherein said locking bolt is movable to a locking position, to an unlocked position, and to a garage position.

11. A device according to claim 1 wherein said locking bolt is longitudinally slidable and carries a plurality of individual contacts of said contact means.

* * * * *